US012546132B2

(12) United States Patent
Barnes

(10) Patent No.: US 12,546,132 B2
(45) Date of Patent: Feb. 10, 2026

(54) SWIMMING POOL TILE WATER WASH SYSTEM TO PREVENT THE FORMATION OF CALCIUM SILICATE DEPOSIT ON GLASS OR PORCELAIN TILE

(71) Applicant: Joseph Barnes, Montgomery, TX (US)

(72) Inventor: Joseph Barnes, Montgomery, TX (US)

( * ) Notice: Subject to any disclaimer, the term of this patent is extended or adjusted under 35 U.S.C. 154(b) by 0 days.

(21) Appl. No.: 18/082,814

(22) Filed: Dec. 16, 2022

(65) Prior Publication Data

US 2024/0200350 A1 Jun. 20, 2024

(51) Int. Cl.
*E04H 4/12* (2006.01)
*E04H 4/16* (2006.01)

(52) U.S. Cl.
CPC ..... *E04H 4/12* (2013.01); *E04H 4/16* (2013.01)

(58) Field of Classification Search
CPC ..... A61H 33/6015; E04H 4/12–1245; E04H 4/14–141; E04H 4/16; E04H 4/1609; E04H 4/1618; E04H 4/1627; E04H 4/1645; E04H 4/1681; E04H 4/169
See application file for complete search history.

(56) References Cited

U.S. PATENT DOCUMENTS 2,430,297 A * 11/1947 Lombardi ..... A47K 3/001 4/591
3,295,540 A * 1/1967 Ortega ..... E04H 4/1681 137/625.5
3,521,304 A * 7/1970 Ghiz ..... E04H 4/169 134/167 R
3,829,911 A * 8/1974 Bishop ..... E04H 4/1227 4/494
4,050,104 A 9/1977 Baker
4,121,307 A 10/1978 Patterson
4,133,058 A 1/1979 Baker
4,206,522 A 6/1980 Baker
4,324,015 A * 4/1982 Head ..... E04H 4/1627 15/52.1
4,383,341 A * 5/1983 Altman ..... B05B 15/74 4/662
4,393,526 A * 7/1983 Miller ..... E04H 4/1681 4/492
4,429,429 A * 2/1984 Altschul ..... E04H 4/1663 134/167 R
4,881,978 A * 11/1989 Van Horssen ..... E04H 4/1618 15/93.1
5,018,890 A * 5/1991 May ..... E04H 4/1281 15/98
5,108,514 A 4/1992 Kisner
(Continued)

FOREIGN PATENT DOCUMENTS

FR 2803864 * 7/2001 ..... E04H 4/1618

*Primary Examiner* — David P Angwin
*Assistant Examiner* — Nicholas A Ros
(74) *Attorney, Agent, or Firm* — Edison Law Group, PLLC

(57) ABSTRACT

The proposed subject matter is intended to alleviate multitudes of home and commercial swimming pool owners from either living with unsightly calcium silicate deposits on their pool walls and/or spending thousands of dollars annually on professional cleaning of their walls to preserve their pool's beauty. The Water Wash System utilizes existing or new pool equipment and infrastructure feeding a simple connection and install of minor tubing on the interior perimeter walls of the pool to mitigate formation of calcium silicate deposit formation.

11 Claims, 4 Drawing Sheets

(56) References Cited

U.S. PATENT DOCUMENTS

Figure 1:
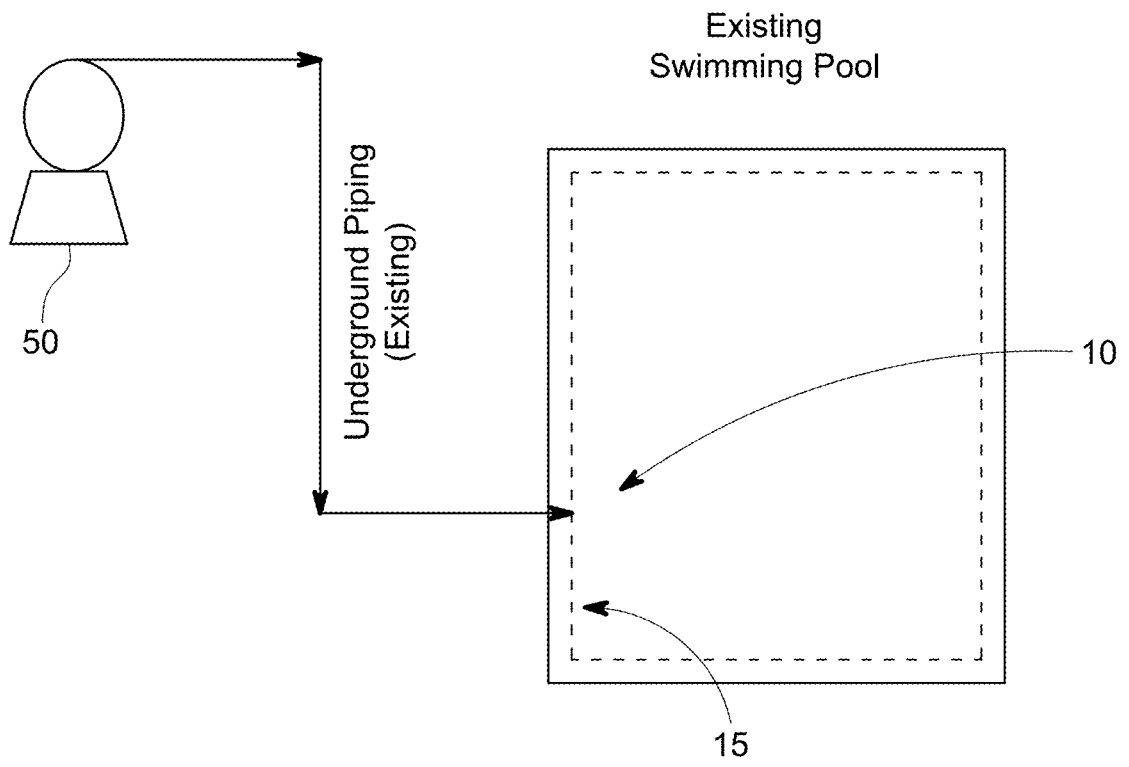

| | | | | |
|---|---|---|---|---|
| 5,221,444 | A * | 6/1993 | Silveri | E04H 4/12 205/744 |
| 5,537,696 | A * | 7/1996 | Chartier | B05B 1/044 4/569 |
| 5,933,883 | A * | 8/1999 | Biancamano | E04H 4/14 4/492 |
| 6,119,707 | A * | 9/2000 | Jordan | E04H 4/1645 134/167 R |
| 7,344,639 | B1 * | 3/2008 | Meincke | E04H 4/1209 4/507 |
| 8,695,128 | B1 * | 4/2014 | Busbey | E04H 4/14 4/507 |
| 2006/0059613 | A1 * | 3/2006 | Feltman | A61H 33/6036 4/496 |
| 2013/0227974 | A1 * | 9/2013 | Kirks | E04H 4/129 62/515 |

* cited by examiner

SWIMMING POOL TILE WATER WASH SYSTEM TO PREVENT THE FORMATION OF CALCIUM SILICATE DEPOSIT ON GLASS OR PORCELAIN TILE

FIELD OF THE INVENTION

The present subject matter relates to the installation of a water wash apparatus to prevent calcium silicate scale from building on the glass or porcelain tile on a swimming pool wall. This idea will provide a continuous cascade of water down the pool wall, maintaining a flush of water on the surface that will eliminate calcium scale from depositing and adhering to the pool tile.

This patent application provides details for both the new installation of a water wash system when a pool is newly constructed and a provision for existing (previously built) pools to add water wash capability.

BACKGROUND OF THE INVENTION

Most swimming pool owners experience the unsightly formation of a calcium deposit ring around the interior perimeter of their backyard oasis on an annual basis. Currently, most owners are forced to hire the services of sand bead blasters to remove the hardened scale deposit, as most liquid and hard surface cleaning applications sold in supply stores either do not work or are difficult to apply.

Sand bead blasting pool walls is an expensive service, typically costing the owner hundreds of dollars, and must typically be reperformed on an annual basis. In addition, the use of sand blasting media to remove the scale requires the use of very small micron sand bead, which settles to the bottom of the pool both during and immediately following the blasting operation. Often, it is very costly to vacuum and remove the sand and the sand pebble media can plug and do damage to the pool's inline filtering system.

Therefore, a need exists to devise a process application that will prevent the formation of the calcium silicate deposit on the wall, adding beauty to the pool while saving the owner money on an ongoing basis.

SUMMARY OF THE INVENTION

The present invention addresses the prevention of calcium silicate scale deposit build on the walls of constructed swimming pools. Installation of systems to prevent these deposits in newly constructed pools as well as already existing pools is covered under this patent application.

Experts in pool water chemistry have determined that calcium silicate scale forms and deposits on the upper dry portion of pool tile when higher pH pool water combines with the presence of higher (mainly summertime) temperature, which promotes evaporation of the pool water at the surface level, permitting the calcium and silicate in the water to deposit out above the water line and onto the dry tile surface, leaving an unsightly scale ring around the pool perimeter, which if allowed to linger, proves to be very difficult to remove from the walls.

For existing pools (previously constructed), the present subject matter's design basis calls for the use of tapping into the existing swimming pool cleaner pump discharge and delivery piping system that exists on most pools for the operation of a pool cleaner.

Use of this existing system prevents the need for installing a separate pump and piping system and eliminates the need to drill a separate hole into the wall of the pool (see FIG. 3) for a water supply connection.

New piping is required to be installed from an existing 2" tap existing on one of the pool walls, and from there, tubing is installed to connect to a water cascade tray (made up of a square, plastic tube) that will distribute water around the interior perimeter of the pool to spill a continuous flow of water over the pool's dry area tile.

For new pools, the invention design basis calls for the installation of a water distribution system, consisting of a circulation pump, underground piping, embedment of a series of water cascade distributors, positioned within and under the bullnose concrete at the pools edge to allow the flow of water over the pool tile during operation. This assembly can be installed by the pool builder during construction.

Theoretically, this water wash will prevent calcium silicate from forming on the tile, eliminating the need for routine removal. Not only will this water wash system prevent scale building but will also add beauty to any pool by creating a water cascade affect around the interior walls of the pool.

BRIEF DESCRIPTION OF THE INVENTION

FIG. 1 serves as an introductory aid to describe the overall intention of the invention. FIG. 1 distinguishes between the typical existing portions of the pool equipment design that will be utilized as part of the process, along with the required equipment to be installed to provide water wash for calcium silicate scale prevention.

Figure 2:
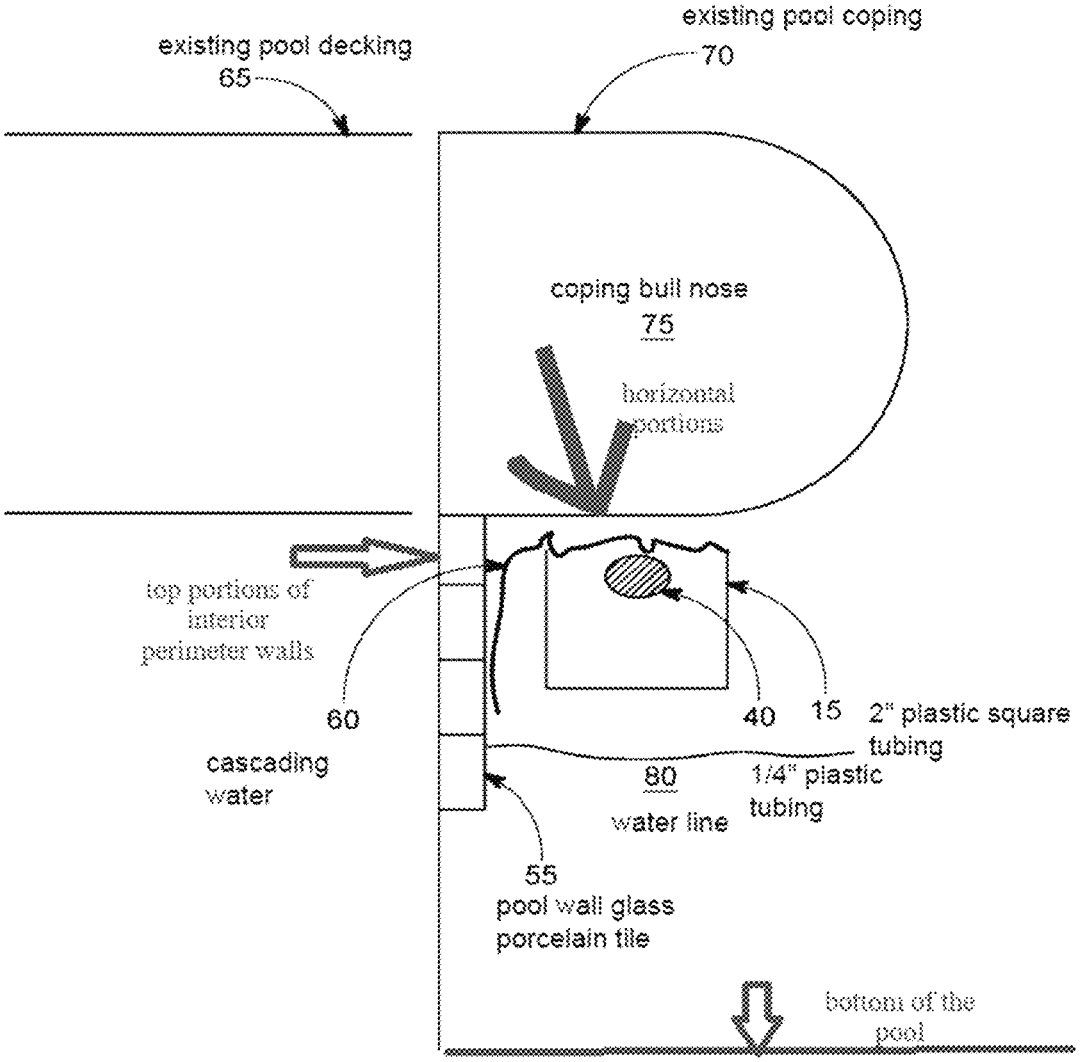

FIG. 2 serves to outline a side view of the piping and tubing to be constructed and connected to existing water supply to provide the pool wall water cascade.

Figure 2B:
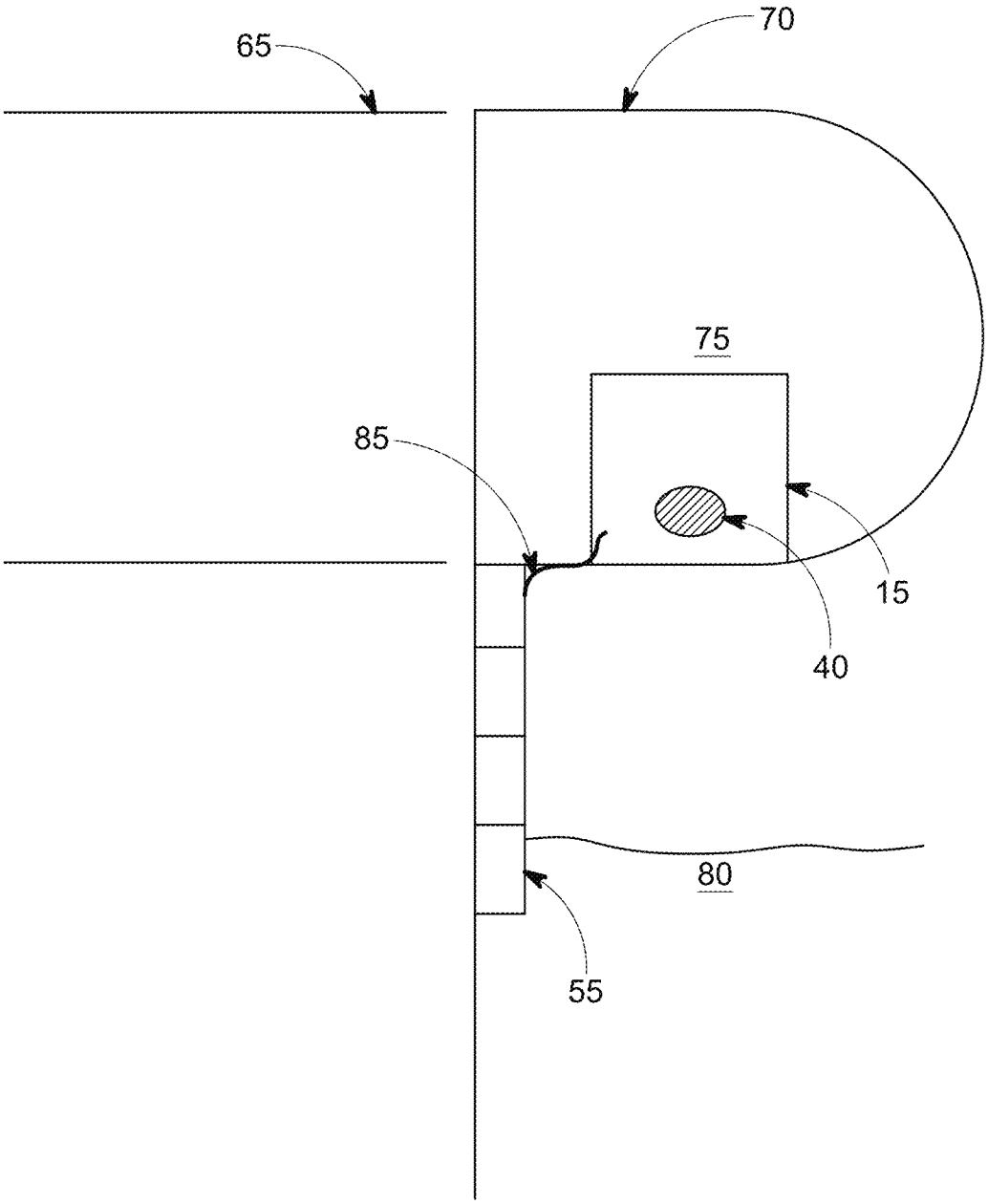

FIG. 2B serves to outline a side view of the piping and tubing to be constructed and connected to a water supply on a newly constructed pool to provide the pool wall water cascade.

Figure 3:
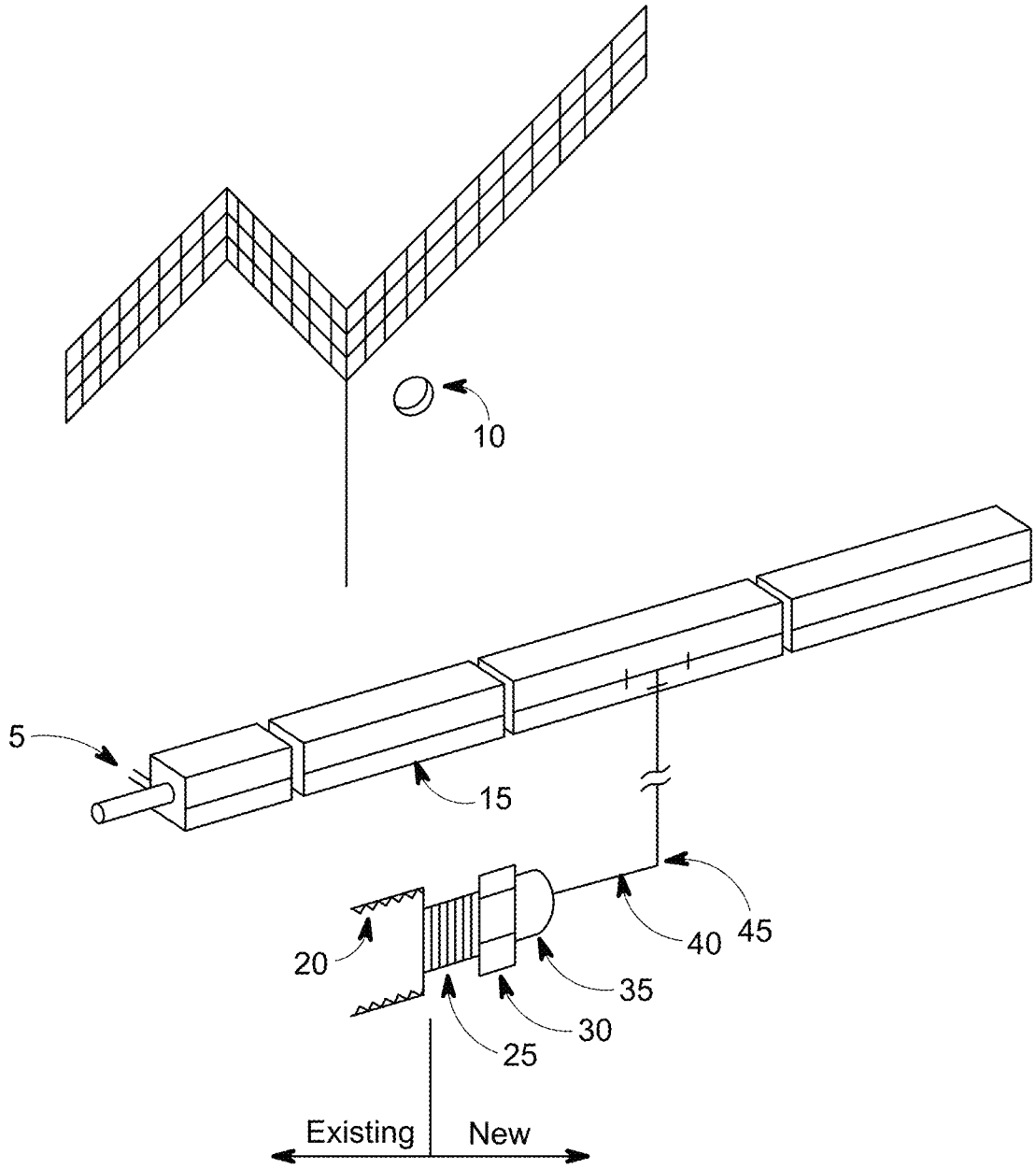

FIG. 3 serves to display the specific guidance to installers on the connections and new tubing to be installed to supply water wash to the pool wall tile to prevent calcium development.

DETAILED DESCRIPTION OF THE INVENTION

As noted previously, the design presented for this patent application for a swimming pool wall water wash system is specifically guided for installation on an existing pool application. A design for new pool installations will be the subject of a separate, future patent application.

FIG. 1 depicts an overhead view of the water wash system. The wall wash system is comprised of utilizing the existing pool cleaner pump 50 and associated piping and the 2" cleaner wall connection on one of the interior walls of the pool. During installation of the completion of the system, a professional pool plumber will be instructed to connect to the 2" cleaner connection to route piping and tubing around the perimeter of the pool to create the water wash cascade required to prevent calcium silicate deposit.

FIG. 2 depicts a cutaway side view of the water wash system. 65 depicts the existing pool decking. 70 depicts existing pool coping. 75 depicts the coping bull nose. 60 depicts the cascading water from the 2" plastic square tubing tray 15 which prevents the build up of calcium silicate. 55 depicts the pool wall glass or porcelain tile which the cascading water 60 descends down into water line 80.

In some embodiments, Water will be supplied to the water wash system via the pool's existing cleaner booster pump. If the pool does not have a cleaner pump, a small auxiliary pump is installed.

From the discharge of the pool cleaner pump, water is allowed to flow to a 2" threaded female connection within the pool that would be available to connect a pressure driven pool cleaner. Plumbing will be connected to the 2" connection to accommodate the installation of tubing and tray to direct water around the interior perimeter of the pool.

As the ¼" tubing supplies water within a 2" plastic tray around the perimeter of the pool, water will spill from the tray onto the pool-wall tile face, providing a continuous wash of the wall face. This contact will prevent calcium silicate from depositing on the pool wall.

Water from the cascade will enter the pool and be recirculated through the pool's existing drain system.

The existing pool cleaner pump is typically designed to deliver 50 psi (pounds per square inch) pressure and up to 12 gallons per minute of water flow. This should be more than adequate to supply enough perimeter cascade flow around a pool. The installer will be required to make any adjustments in tubing size and type to accommodate existing pump capacity and pool size. The pool owner will be instructed to operate the cleaning pump on a continuous basis (or at least throughout warmer daylight hours during summer months).

Water from the cleaner pump (hereby referred to as the wash water supply pump) will be supplied to the pool through existing above and below grade piping, enroute to a wall connection within the pool perimeter. Using newly installed piping and tubing as depicted in FIGS. 2 and 3, water will flow through a ¼" round tube to fill a 2" square plastic channel that will allow water to overflow its open side, which will be oriented toward the tiled face of the pool walls.

The system will supply a flat, evenly distributed flow of water to the walls, providing a flush to prevent deposits and keeping the walls cooled to protect against evaporation of surrounding pool water. This design will provide a simple installation and operation that should solve an age-old problem for most pool owners.

FIG. 2B depicts a cutaway side view of the water wash system for a newly constructed pool. The water wash system is constructed into the coping so that the apparatus is out of sight. 65 depicts the existing pool decking. 70 depicts existing pool coping. 75 depicts the coping bull nose. 60 depicts the cascading water from the 2" plastic square tubing tray 15 which prevents the buildup of calcium silicate. 55 depicts the pool wall glass or porcelain tile which the cascading water 60 descends into water line 80. Rounded edges 85, directs the flow towards the pool wall 55 and helps prevent any kind of water dripping directly into the pool without first cascading down the side.

FIG. 3 depicts perspective view of the water wash detail system. 5 depicts a tubing split to create the wash water cascade on the pool wall. 10 depicts the first end of the 2" pool cleaner connection. 15 depicts the 2" square plastic which connects to the pool coping. 20 depicts the corresponding second end of the 2" pool cleaner connection. 25 depicts the 1" male to 1" male connector. 30 depicts the 2" screwed coupling. 35 depicts the 2"×¼" screw reducer. 40 depicts the ¼" plastic tubing and 45 depicts the ¼" 90 degree elbow.

I claim:

1. A Water Wash System which utilizes existing pool equipment and infrastructure feeding a connection and tubing on the interior perimeter walls of the pool to mitigate formation of calcium silicate deposit formation comprising:

a ¼" plastic round supply tubing;

a 2" plastic square tubing tray attached to top portions of the interior perimeter walls of the pool such that the base of the tray is perpendicular to a vertical face of the interior perimeter walls;

a coupling configured to tie into an existing 2" female threaded pool cleaning system return connection;

a pre-existing pool cleaner pump;

wherein the 2" plastic square tubing tray is affixed to the bottom of pool coping; and wherein the supply tubing, tubing tray, coupling, and cleaner pump are all fluidly connected, wherein the supply tubing is configured to receive water from the coupling and deliver it into the tubing tray which is configured such that upon overflowing the tubing tray the water supplied from the supply tubing will cascade down the interior perimeter walls of the pool and thereby mitigates the formation of calcium silicate deposit formation on the interior perimeter walls of the pool.

2. The Water Wash System which utilizes existing pool equipment and infrastructure feeding a connection and tubing on the interior perimeter walls of the pool to mitigate formation of calcium silicate deposit as in claim 1, wherein the coupling feeds water into the ¼" plastic round supply tubing.

3. The Water Wash System which utilizes existing pool equipment and infrastructure feeding a connection and tubing on the interior perimeter walls of the pool to mitigate formation of calcium silicate deposit as in claim 1, wherein the pre-existing pool cleaner pump feeds water into the coupling.

4. A method of constructing a Water Wash System which utilizes existing pool equipment and infrastructure feeding a connection and tubing on the interior perimeter walls of the pool to mitigate formation of calcium silicate deposit formation, said method comprising:

installing and connecting components, said installed and connected components comprising, a ¼" plastic round supply tubing;

a 2" plastic square tubing tray that contains the ¼" plastic round supply tubing and which is attached to top portion of the interior perimeter walls of the pool such that the base of the tray is perpendicular to a vertical face of the interior perimeter walls;

a coupling configured to tie into an existing 2" female threaded pool cleaning system return connection, which coupling is fluidly connected to the ¼" plastic round supply tubing; and a pre-existing pool cleaner pump that is fluidly connected to the coupling;

pumping pool water into the installed and connected components; and cascading pool water down the interior perimeter walls of the pool by supplying water from the pre-existing pool cleaner pump through the coupling into the plastic round supply tubing which fills the plastic square tubing tray until the tray overflows and the pool water runs down the interior perimeter walls thereby mitigating the formation of calcium silicate deposit formation on the interior perimeter walls of the pool.

5. The method of constructing the Water Wash System which utilizes existing pool equipment and infrastructure feeding a connection and tubing on the interior perimeter walls of the pool to mitigate formation of calcium silicate deposit as in claim 4, wherein the 2" plastic square tubing tray is affixed to the bottom of pool coping.

6. The method of constructing the Water Wash System which utilizes existing pool equipment and infrastructure feeding a connection and tubing on the interior perimeter walls of the pool to mitigate formation of calcium silicate deposit as in claim 4, wherein the ¼" plastic round supply tubing fills the 2" plastic square tubing tray with water.

7. The method of preventing calcium silicate deposit formation on interior perimeter walls of a swimming pool as in claim 4, wherein the 2" plastic square tubing tray comprises a rounded edge configured to direct water flow toward the interior perimeter walls of the pool.

8. The method of preventing calcium silicate deposit formation on interior perimeter walls of a swimming pool as in claim 4, wherein the pre-existing pool cleaner pump delivers water at approximately 50 pounds per square inch pressure.

9. The method of preventing calcium silicate deposit formation on interior perimeter walls of a swimming pool as in claim 4, wherein the pre-existing pool cleaner pump delivers water at a flow rate of up to 12 gallons per minute.

10. The method of preventing calcium silicate deposit formation on interior perimeter walls of a swimming pool as in claim 4, further comprising creating a wash water cascade on the interior perimeter walls of the pool using a tubing split.

11. The method of preventing calcium silicate deposit formation on interior perimeter walls of a swimming pool as in claim 4, further comprising maintaining the interior perimeter walls of the pool in a continuously wet state to prevent calcium silicate from depositing and adhering to the interior perimeter walls of the pool.

* * * * *